US009640075B2

(12) United States Patent
Shen

(10) Patent No.: US 9,640,075 B2
(45) Date of Patent: May 2, 2017

(54) PARKING INFORMATION UPDATING METHOD AND ELECTRONIC DEVICE PERFORMING THE SAME

(71) Applicant: Pegatron Corporation, Taipei (TW)

(72) Inventor: Szu-Ju Shen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 14/928,534

(22) Filed: Oct. 30, 2015

(65) Prior Publication Data

US 2016/0125737 A1 May 5, 2016

(30) Foreign Application Priority Data

Oct. 31, 2014 (TW) ..... 103137918 A

(51) Int. Cl.

| | |
|---|---|
| ***G08B 21/00*** | (2006.01) |
| ***G08G 1/14*** | (2006.01) |
| ***G08G 1/005*** | (2006.01) |

(52) U.S. Cl.
CPC ..... *G08G 1/147* (2013.01); *G08G 1/005* (2013.01)

(58) Field of Classification Search
CPC ..... G08G 1/14
USPC ..... 340/932.2; 701/454
See application file for complete search history.

(56) References Cited

U.S. PATENT DOCUMENTS

2014/0156183 A1 6/2014 Windeler et al.

*Primary Examiner* — Jeffery Hofsass
(74) *Attorney, Agent, or Firm* — Muncy, Geissler, Olds & Lowe, P.C.

(57) ABSTRACT

A parking information updating method is disclosed. The parking information updating method is used to analyze the behavior model of a user according to the relative movement between an electronic device carried by the user and a parking space, to determine whether the parking space is occupied or not.

15 Claims, 3 Drawing Sheets

PARKING INFORMATION UPDATING METHOD AND ELECTRONIC DEVICE PERFORMING THE SAME

CROSS-REFERENCE TO RELATED APPLICATIONS

This Non-provisional application claims priority under 35 U.S.C. §119(a) on Patent Application No(s). 103137918 filed in Taiwan, Republic of China on Oct. 31, 2014, the entire contents of which are hereby incorporated by reference.

BACKGROUND

Technology Field

The disclosure relates to a parking information updating method and, more particularly, to a parking information updating method for a roadside parking space.

Description of the Related Art

With the economic development, the number of vehicles and motorcycles has become more and more. However, because of space is limited, there are limited parking spaces. Drivers always spend so much time finding parking lots or roadside parking spaces, especially in the metropolitan area.

The existing parking information only shows if parking spaces in indoor parking lots are occupied. Although there are applications providing information about the distribution of roadside parking spaces in some area of a city for drivers. Those applications do not provide information showing whether each roadside parking space in the city is occupied. Drivers may drive to the nearest roadside parking space according to the information provided by those applications, but find that the roadside parking space has already occupied by another car. Thus the drivers spend more time and money finding a roadside parking space.

SUMMARY

A main objective of the invention is to provide a parking information updating method for a roadside parking space.

Another objective of the invention is to provide an electronic device performing the above method.

To achieve the above objectives, the parking information updating method of the invention is applicable to an electronic device for determining and updating parking information relative to whether a roadside parking space is available for parking. The electronic device has a positioning data acquiring system for acquiring positioning data of the electronic device. The electronic device connects to a server system through a network to acquire parking space distribution data and parking space usage state data. The parking information updating method of the invention includes the following steps. Whether the electronic device approaches a coordinate location of the roadside parking space with a walking speed is determined according to the parking space distribution data and the positioning data acquired from the positioning data acquiring system. If so, after the electronic device arrives at the coordinate location, whether the electronic device has stayed at the coordinate location for a predetermined departure time is determined. If so, whether the electronic device speeds up to a driving speed to depart from the coordinate location is determined. If so, a first instruction for changing a usage state of the roadside parking space is sent to the sever system, such that the sever system changes the parking space usage state data according to the first instruction, and changes the usage state of the roadside parking space to an unoccupied state.

According to another embodiment of the invention, the parking information updating method of the invention includes the following steps. Whether the electronic device approaches a coordinate location of the roadside parking space in deceleration from a driving speed is determined according to the parking space distribution data and the positioning data acquired from the positioning data acquiring system. If so, whether an elapsed time during which the electronic device has stayed at the coordinate location is less than a predetermined time is determined. If so, whether the electronic device departs from the coordinate location with a walking speed is determined. If so, a second instruction for changing a usage state of the roadside parking space is sent to the sever system, such that the sever system changes the parking space usage state data according to the second instruction, and changes the usage state of the roadside parking space to an occupied state.

The invention further provides an electronic device performing the above parking information updating method. The electronic device is capable of connecting to a server system through a network to acquire parking space distribution data and parking space usage state data. The electronic device of the invention includes a positioning data acquiring system, a network connecting device and a processor. The positioning data acquiring system is for acquiring positioning data of the electronic device. The network connecting device is for connecting to the network to allow the electronic device to connect to the server system through the network. The processor is electrically coupled with the positioning data acquiring system and the network connecting device. The processor is configured to determine a speed of the electronic device when the electronic device approaches a coordinate location of a roadside parking space according to the parking space distribution data and the positioning data. The processor is capable of determining an elapsed time during which the electronic device has stayed at the coordinate location, the processor is capable of determining the speed of the electronic device when the electronic device departs from the coordinate location, and the processor is capable of sending a first instruction or a second instruction for changing a usage state of the roadside parking space to the sever system through the network.

DETAILED DESCRIPTION

The advantages and innovative features of the invention will become more apparent from the following preferred embodiments.

Figure 1:
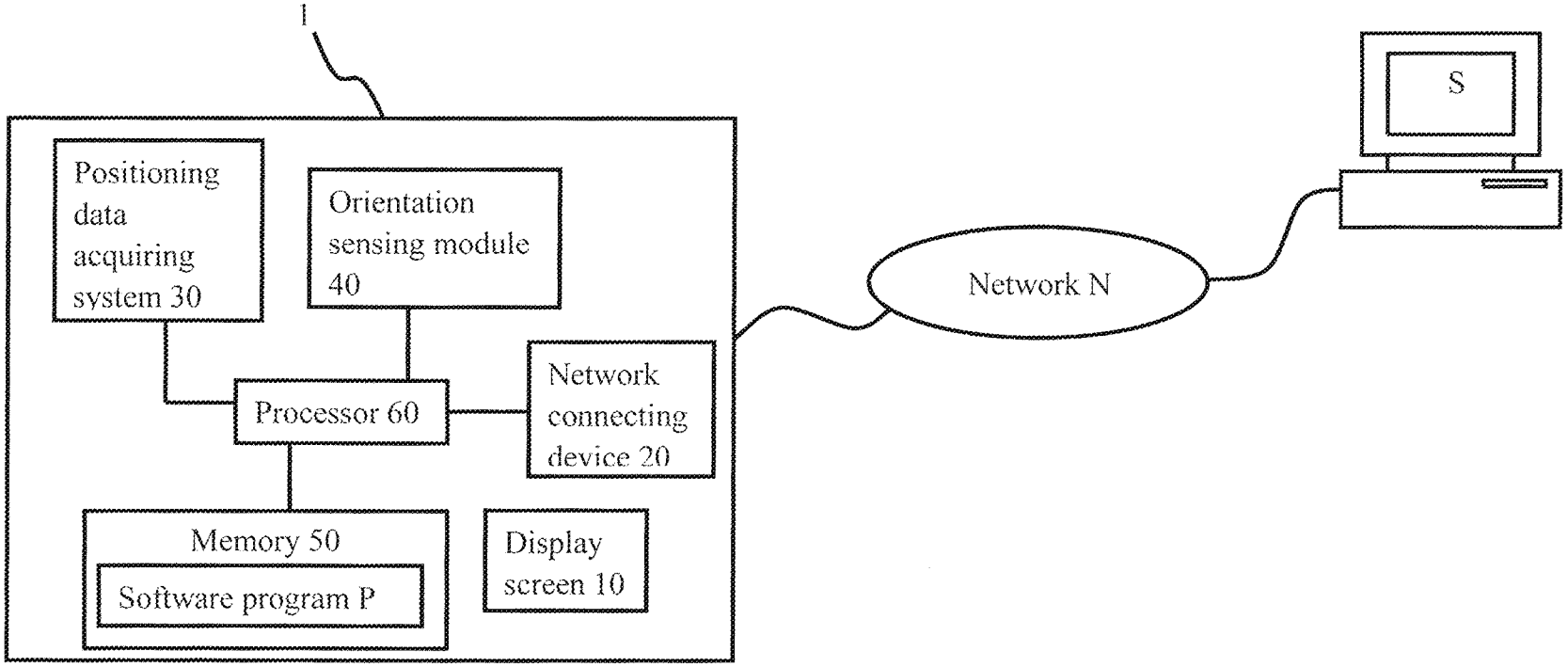
FIG. 1 shows an environment in which an electronic device according to an embodiment of the invention is used.

Refer to FIG. 1 which shows an environment in which an electronic device according to an embodiment of the invention is used.

As shown in FIG. 1, the electronic device 1 is capable of connecting to a server system S through a network N to acquire parking space usage state data from the sever system S. The electronic device 1 includes a display screen 10, a network connecting device 20, a positioning data acquiring system 30, an orientation sensing module 40, a memory 50 and a processor 60. In this embodiment of the invention, the electronic device 1 may be an intelligent mobile phone, but the invention is not limited thereto.

The display screen 10 such as a liquid crystal display is used for displaying image frames to allow users to watch and operate.

The network connecting device 20 such as a wireless network module is used for connecting to the network N to allow the electronic device 1 to connect to the server system S through the network N.

The positioning data acquiring system 30 is used for acquiring positioning data of the electronic device 1. In this embodiment of the invention, the positioning data acquiring system 30 may be a global position system (GPS), but the invention is not limited thereto. Because the positioning data of the intelligent mobile can be acquired by many methods, and these methods are conventional technologies known by those skilled in the art and are shown on relevant technical documents or other patents, these methods are not the focus of the present invention. Thus these methods will not be discussed in further details.

The orientation sensing module 40 is used for detecting and acquiring sensing information relative to the orientation or the displacement of the electronic device 1. For example, the orientation sensing module 40 may include a gravity sensor, a gyroscope, an electronic compass and an altimeter, etc., but the invention is not limited thereto. The above mentioned elements are conventional elements, and the structures, functions and sensing theories of these elements are known by those skilled in the art, so it will not be discussed in further details.

The memory 50 is used for storing a software program P. The processor 60 is electrically coupled with the network connecting device 20, the positioning data acquiring system 30, the orientation sensing module 40 and the memory 50. The processor 60 is used for performing relevant processing operations. In this embodiment of the invention, when the software program P is loaded from the memory 50 and performed by the processor 60, the processor 60 may perform the following parking information updating method.

Figure 2:
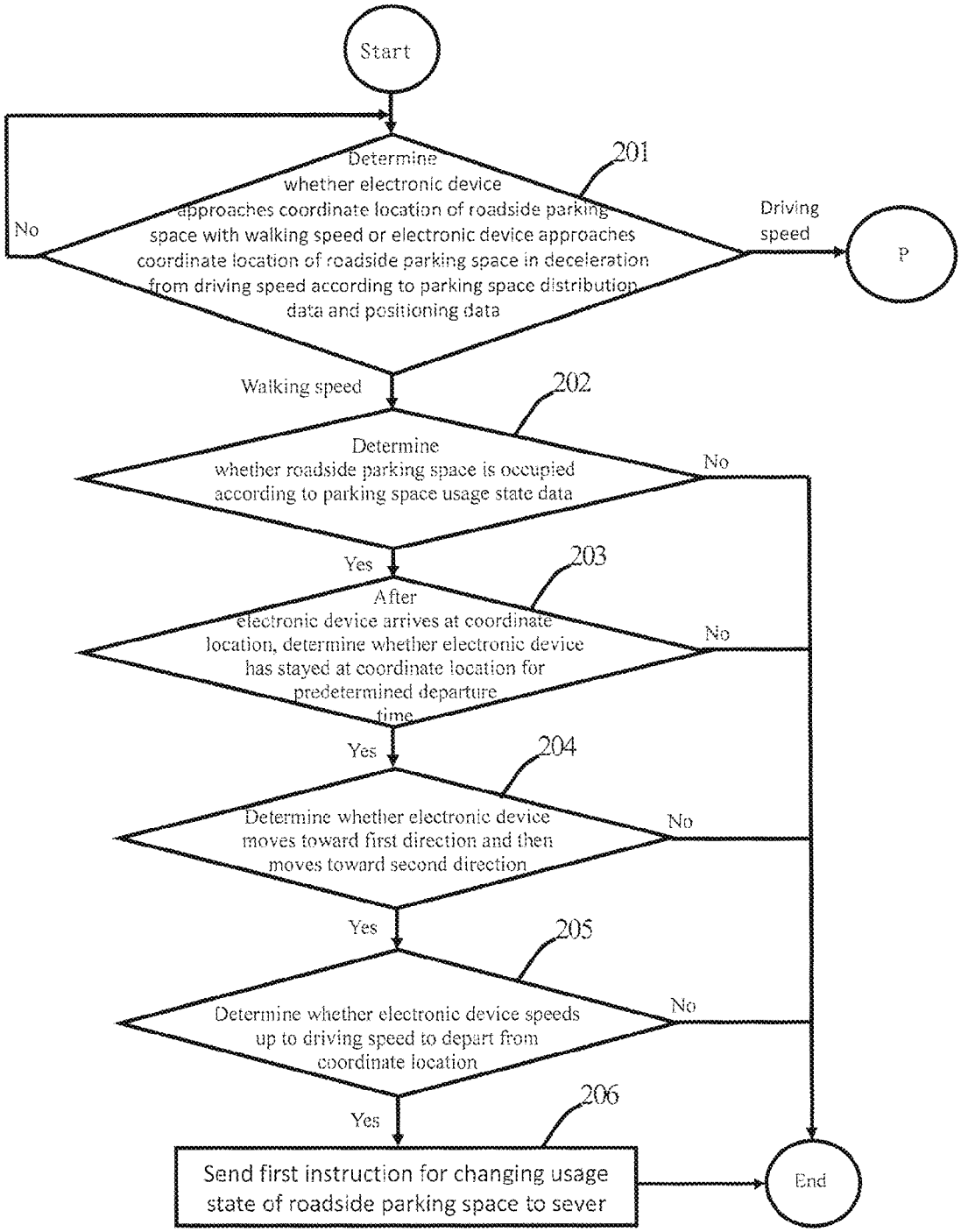
FIG. 2 shows a first flow chart of a parking information updating method according to an embodiment of the invention.
Figure 3:
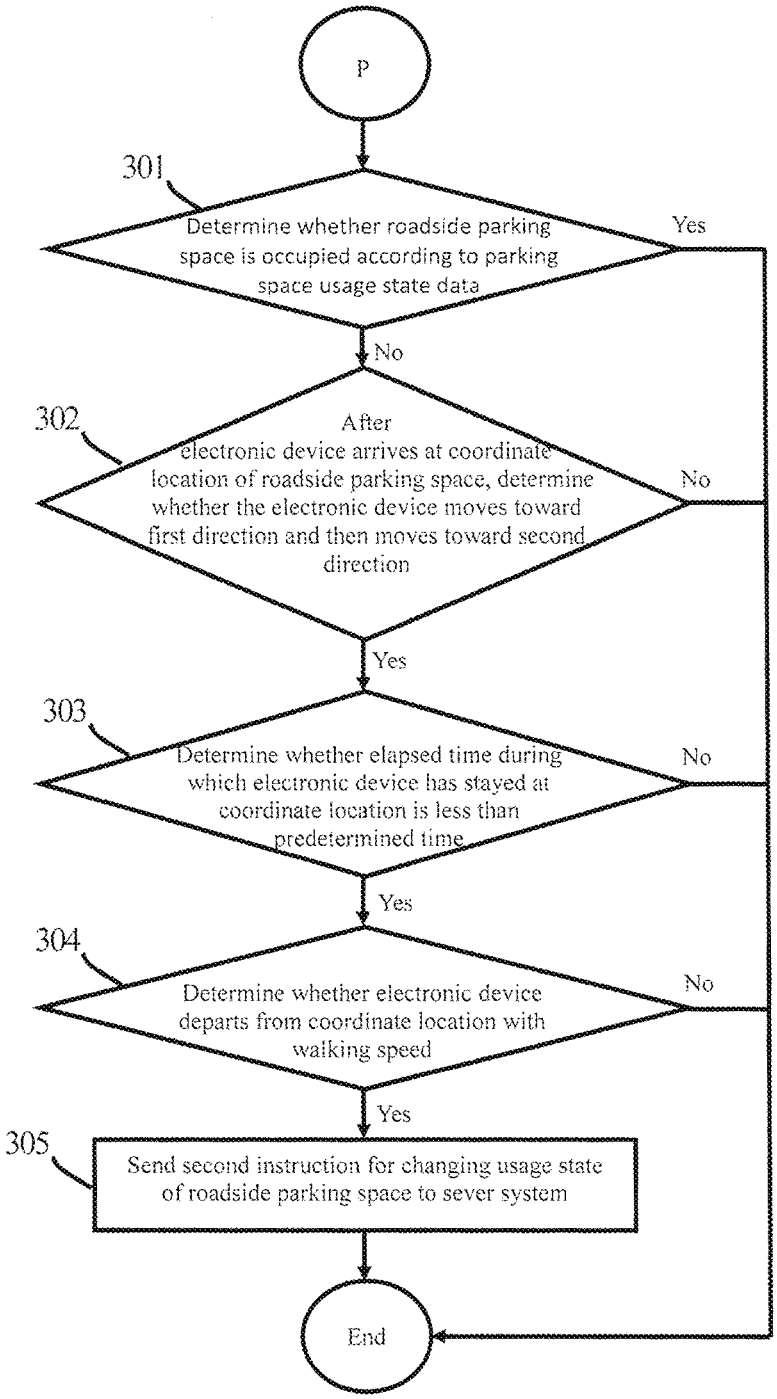
FIG. 3 shows a second flow chart of a parking information updating method according to an embodiment of the invention.

Please refer to FIG. 1-3. FIG. 2 shows a first flow chart of a parking information updating method according to an embodiment of the invention, and the steps in FIG. 2 are for picking up a car. FIG. 3 shows a second flow chart of a parking information updating method according to an embodiment of the invention, and the steps in FIG. 3 are for parking a car. The steps in FIG. 2 and FIG. 3 will be illustrated in further details in accompany with FIG. 1.

In step 201, whether the electronic device 1 approaches a coordinate location of a roadside parking space with a walking speed or the electronic device 1 approaches the coordinate location of the roadside parking space in deceleration from a driving speed is determined according to parking space distribution data and the positioning data.

The parking information updating method is capable of determining whether a user is parking or picking up a car according to the relative movement between the electronic device 1 carried by the user and the roadside parking space, and then the parking information updating method is capable of updating the parking space usage state data according to the user is picking up the car or parking the car. Therefore, at the beginning, the processor 60 will determine a speed of the electronic device 1 when the electronic device 1 approaches the coordinate location of the roadside parking space according to the parking space distribution data and the positioning data, and further determine whether the electronic device 1 approaches the coordinate location of the roadside parking space with the walking speed or the electronic device 1 approaches the coordinate location in deceleration from the driving speed. The parking space distribution data may be downloaded through the network N by the user in advance and stored in the electronic device 1, or the parking space distribution data may be provided by the sever system S. The parking space distribution data record geographical locations and coordinate data of all the roadside parking spaces in some area. Thus the processor 60 may determine whether the electronic device 1 approaches the coordinate location of the roadside parking space with the walking speed or the electronic device 1 approaches the coordinate location in deceleration from the driving speed by the comparison analysis of the parking space distribution data and the positioning data.

Once the processor 60 determines that the electronic device 1 approaches the coordinate location of the roadside parking space with the walking speed, the processor 60 will perform the judgments relative to picking up a car, i.e. steps 202-206. On the contrary, if the processor 60 determines that the user approaches the coordinate location of the roadside parking space in deceleration from the driving speed, the judgments relative to parking a car will be performed, i.e. steps 301-305.

In step 202, whether the roadside parking space is occupied is determined according to the parking space usage state data.

When the processor 60 determines that the electronic device 1 is approaching the coordinate location of the roadside parking space with the walking speed, then the processor 60 will determine whether the roadside parking space is occupied according to the parking space usage state data. The parking space usage state data is provided by the sever system S, and the parking space usage state data will be updated with the usage state of each parking space.

In step 203, after the electronic device 1 arrives at the coordinate location, whether the electronic device 1 has stayed at the coordinate location for a predetermined departure time is determined.

Generally speaking, when a driver picks up a car and arrives at a parking location, it will take a short time to open the car door, start the car and allow other cars coming from behind to go first before the driver drives away from the parking location. Therefore, after step 202 is performed and the processor 60 determines the roadside parking space is occupied, the processor 60 then will determine that whether the electronic device 1 has stayed at the coordinate location for the predetermined departure time according to the parking space distribution data and the positioning data after the electronic device 1 arrives at the coordinate location. That is, the processor 60 will determine how long has the electronic device 1 stayed at the coordinate location of the roadside parking space after the electronic device 1 arrives at the coordinate location. In the embodiment of the invention, the predetermined departure time is previously set within a range from one to three minutes when the user picks up the car at the first time. After the user has picked up the car for many times, the average time (such as 1 minute and 30 seconds) of each departure time will be recorded as a new predetermined departure time. In other words, after the user starts to use the parking information updating method, the predetermined departure time will be changed depending on the amount of time each user spend for picking up the car.

Additionally, another way for updating the predetermined departure time is provided according to the embodiment of the invention. The electronic device 1 may provide an input interface. Every time after the user starts the car, the user may use the input interface to notice the processor 60 that the car is started. Thus the processor 60 may regard the amount of time, started from the electronic device 1 arriving at the coordinate location to the processor 60 receiving the user's notice, as the predetermined departure time of this time. By using this way many times, the average time of each predetermined departure time will be set as a new predetermined departure time. Surely, the predetermined departure time may be set as a constant time, and the invention is not limited by the above ways to set the predetermined departure time.

In step 204, whether the electronic device 1 moves toward a first direction and then moves toward a second direction is determined.

Typically, when the driver drives the car out of the roadside parking space, the driver will first drive backward a bit, and then drive forward turning to the road; or the driver will drive forward first, and then drive backward turning to the road. Therefore, after step 203 is performed and the processor 60 determines that the electronic device 1 has stayed at the coordinate location for the predetermined departure time, the processor 60 then will determine that whether the electronic device 1 moves toward a first direction (i.e., the rear side of the car in this embodiment) and then moves toward a second direction (i.e., the front side of the car in this embodiment). The angle difference between the first direction and the second direction is approximately 180 degrees. The first direction may be the front side of the car, and the second direction may be the rear side of the car. Please note that step 204 may be determined according to the changes of the coordinate location on the positioning data, and it also may be determined according to the sensing information acquired from the orientation sensing module 40.

In step 205, whether the electronic device 1 speeds up to the driving speed to depart from the coordinate location is determined.

Once the processor 60 determines that the electronic device 1 moves toward the first direction and then moves toward the second direction, the processor 60 then will determine whether the electronic device 1 speeds up to the driving speed to depart from the coordinate location of the roadside parking space according to the parking space distribution data and the positioning data. That is, the electronic device 1 will determine the speed of the electronic device 1 when the electronic device 1 departs away from the coordinate location.

In step 206, a first instruction for changing a usage state of the roadside parking space is sent to the sever system S.

Once the processor 60 determines that the electronic device 1 finally speeds up to the driving speed to depart from the coordinate location of the roadside parking space in step 205, it means the user drives the car away from the roadside parking space. At the moment, the processor 60 will send the first instruction for changing the usage state of the roadside parking space to the sever system S according to the above determined result. After the server system S receives the first instruction, the server system S will instantly change the usage state of the roadside parking space from an occupied state to an unoccupied state according to the first instruction.

After the usage state of the roadside parking space is changed, the original user and the other users using the parking information updating method may acquire the new parking space usage state data through the electronic device 1 connecting to the sever system S. At the moment, the new parking space usage state data will show that the usage state of the roadside parking space is in the unoccupied state.

In step 301, whether the roadside parking space is occupied is determined according to the parking space usage state data.

Once the processor 60 determines that the electronic device 1 approaches the coordinate location of the roadside parking space in deceleration from the driving speed in step 201, the processor 60 will also determine whether the roadside parking space is occupied. When the processor 60 determines that the roadside parking space is unoccupied, the processor 60 will perform the following steps.

In step 302, after the electronic device 1 arrives at the coordinate location of the roadside parking space, whether the electronic device 1 moves toward the first direction and then moves toward the second direction is determined.

Typically, when the driver parks the car in the roadside parking space, the driver will reverse the car into the roadside parking space. When the driver arrives at the roadside parking space, the driver will drive forward a bit, and then drive backward slowly into the roadside parking space. Therefore, once the step 301 is performed and the processor 60 determines that the electronic device 1 approaches the unoccupied roadside parking space in deceleration from the driving speed, the processor 60 then will determine that whether the electronic device 1 moves toward the first direction and then moves toward the second direction after the electronic device 1 arrives at the coordinate location of the roadside parking space. The angle difference between the first direction and the second direction is approximately 180 degrees. Similarly, step 302 may be determined according to the changes of the coordinate location on the positioning data, and it also may be determined according to the sensing information acquired from the orientation sensing module 40.

In step 303, whether the elapsed time during which the electronic device 1 has stayed at the coordinate location is less than a predetermined time is determined.

Moreover, when the processor 60 determines that the electronic device 1 moves toward the first direction and then moves toward the second direction after the electronic device 1 arrives at the coordinate location of the roadside parking space, the processor 60 then will determine whether the elapsed time during which the electronic device 1 has stayed at the coordinate location is less than the predetermined time according to the positioning data. That is, the processor 60 will determine how long has the electronic device 1 stayed at the coordinate location of the roadside parking space after the electronic device 1 arrives at the coordinate location. In the embodiment of the invention, the initial predetermined time is set within a range from one to two minutes. The predetermined time will also be adjusted with different user experiences. The manner for adjusting the predetermined time is similar to the above mentioned predetermined departure time, so it will not be discussed in further details.

In step 304, whether the electronic device 1 departs from the coordinate location with the walking speed is determined.

After the processor 60 determines that the elapsed time during which the electronic device 1 has stayed at the coordinate location is less than the predetermined time, the processor 60 then will determine whether the electronic device 1 departs from the coordinate location of the roadside parking space with the walking speed according to the parking space distribution data and the positioning data. That is, the processor 60 will determine the speed of the electronic device 1 when the electronic device 1 departs from the coordinate location of the roadside parking space.

In step 305, a second instruction for changing the usage state of the roadside parking space is sent to the sever system S.

Once the processor 60 determines that the electronic device 1 finally departs from the coordinate location of the roadside parking space with the walking speed in step 304, it means the user has parked the car and got off the car and walked away from the parking location. Therefore, after the step 304 is performed, the processor 60 will send the second instruction for changing the usage state of the roadside parking space to the sever system S. After the sever system S receives the second instruction, the server system S will instantly change the usage state of the roadside parking space from the unoccupied state to the occupied state according to the second instruction. That is, the parking space usage state data are updated.

Please note that the parking information updating method is not limited to the above step order. The order or steps may be changed once the objective of the invention may be achieved.

The foregoing descriptions of embodiments of the invention have been presented only for purposes of illustration and description. They are not intended to be exhaustive or to limit the invention to the forms disclosed. Accordingly, many modifications and variations will be apparent to practitioners skilled in the art. Additionally, the above disclosure is not intended to limit the invention. The scope of the present invention is defined by the appended claims.

What is claimed is:

1. A parking information updating method applicable to an electronic device for acquiring and updating parking information relative to whether a roadside parking space is available for parking, the electronic device having a positioning data acquiring system for acquiring positioning data of the electronic device, and the electronic device connecting to a server system through a network to acquire parking space distribution data and parking space usage state data, the parking information updating method comprising:

determining whether the electronic device approaches a coordinate location of the roadside parking space with a walking speed according to the parking space distribution data and the positioning data acquired from the positioning data acquiring system;

if so, after the electronic device arrives at the coordinate location, determining whether the electronic device has stayed at the coordinate location for a predetermined departure time;

if so, determining whether the electronic device moves toward a first direction and then moves toward a second direction after the predetermined departure time, wherein the angle difference between the first direction and the second direction is approximately 180 degrees;

if so, determining whether the electronic device speeds up to a driving speed to depart from the coordinate location; and if so, sending a first instruction for changing a usage state of the roadside parking space to the sever system, such that the sever system changes the parking space usage state data according to the first instruction, and changes the usage state of the roadside parking space to an unoccupied state.

2. The parking information updating method according to claim 1, wherein before determining whether the electronic device has stayed at the coordinate location for the predetermined departure time, the method further comprises:

determining whether the roadside parking space is occupied according to the parking space usage state data.

3. The parking information updating method according to claim 1, wherein the walking speed is within a range between about 3 kilometers per hour and 5.5 kilometers per hour.

4. The parking information updating method according to claim 1, wherein the driving speed is within a range between about 10 kilometers per hour and 60 kilometers per hour.

5. A parking information updating method applicable to an electronic device for determining and updating parking information relative to whether a roadside parking space is available for parking, the electronic device having a positioning data acquiring system for acquiring positioning data of the electronic device, and the electronic device connecting to a server system through a network to acquire parking space distribution data and parking space usage state data, the parking information updating method comprising:

determining whether the electronic device approaches a coordinate location of the roadside parking space in deceleration from a driving speed according to the parking space distribution data and the positioning data acquired from the positioning data acquiring system;

if so, determining whether the electronic device moves toward a first direction and then moves toward a second direction, wherein the angle difference between the first direction and the second direction is approximately 180 degrees;

if so, determining whether an elapsed time during which the electronic device has stayed at the coordinate location is less than a predetermined time;

if so, determining whether the electronic device departs from the coordinate location with a walking speed; and if so, sending a second instruction for changing a usage state of the roadside parking space to the sever system, such that the sever system changes the parking space usage state data according to the second instruction, and changes the usage state of the roadside parking space to an occupied state.

6. The parking information updating method according to claim 5, wherein before determining whether the elapsed time during which the electronic device has stayed at the coordinate location is less than the predetermined time, the method further comprises:

determining whether the roadside parking space is occupied according to the parking space usage state data.

7. The parking information updating method according to claim 5, wherein the walking speed is within a range between about 3 kilometers per hour and 5.5 kilometers per hour.

8. The parking information updating method according to claim 5, wherein the driving speed is within a range between about 10 kilometers per hour and 60 kilometers per hour.

9. An electronic device, capable of connecting to a server system through a network to acquire parking space distribution data and parking space usage state data, the electronic device comprising:

a positioning data acquiring system for acquiring positioning data of the electronic device;

a network connecting device for connecting to the network to allow the electronic device to connect to the server system through the network; and a processor electrically coupled with the positioning data acquiring system and the network connecting device, the processor being configured to determine a speed of the electronic device when the electronic device approaches a coordinate location of a roadside parking space according to the parking space distribution data and the positioning data, the processor being capable of determining an elapsed time during which the electronic device has stayed at the coordinate location, the processor being capable of determining the speed of the electronic device when the electronic device departs from the coordinate location, and the processor being capable of sending a first instruction or a second instruction for changing a usage state of the roadside parking space to the sever system through the network;

wherein when the processor determines that the electronic device approaches the coordinate location with a walking speed, determines that the electronic device has stayed at the coordinate location for a predetermined departure time after arriving at the coordinate location, and determines that the electronic device moves toward a first direction and then moves toward a second direction and then speeds up to a driving speed to depart from the coordinate location after the predetermined departure time, wherein the angle difference between the first direction and the second direction is approximately 180 degree, the processor sends the first instruction to the sever system, such that the sever system changes the parking space usage state data according to the first instruction, and changes the usage state of the roadside parking space to an unoccupied state.

10. An electronic device, capable of connecting to a server system through a network to acquire parking space distribution data and parking space usage state data, the electronic device comprising:

a positioning data acquiring system for acquiring positioning data of the electronic device;

a network connecting device for connecting to the network to allow the electronic device to connect to the server system through the network; and a processor electrically coupled with the positioning data acquiring system and the network connecting device, the processor being configured to determine a speed of the electronic device when the electronic device approaches a coordinate location of a roadside parking space according to the parking space distribution data and the positioning data, the processor being capable of determining an elapsed time during which the electronic device has stayed at the coordinate location, the processor being capable of determining the speed of the electronic device when the electronic device departs from the coordinate location, and the processor being capable of sending a first instruction or a second instruction for changing a usage state of the roadside parking space to the sever system through the network;

wherein when the processor determines that the electronic device approaches the coordinate location in deceleration from a driving speed, determines that the electronic device moves toward a first direction and then moves toward a second direction, wherein the angle difference between the first direction and the second direction is approximately 180 degrees, determines that the elapsed time during which the electronic device has stayed at the coordinate location is less than a predetermined time, and determines that the electronic device departs from the coordinate location with a walking speed after the predetermined time, the processor sends the second instruction to the sever system, such that the sever system changes the parking space usage state data according to the second instruction, and changes the usage state of the roadside parking space to an occupied state.

11. The electronic device according to claim 9, wherein before the processor determines the elapsed time during which the electronic device has stayed at the coordinate location, the processor is capable of determining whether the roadside parking space is occupied according to the parking space usage state data.

12. The electronic device according to claim 9, wherein the walking speed is within a range between about 3 kilometers per hour and 5.5 kilometers per hour.

13. The electronic device according to claim 10, wherein the walking speed is within a range between about 3 kilometers per hour and 5.5 kilometers per hour.

14. The electronic device according to claim 9, wherein the driving speed is within a range between about 10 kilometers per hour and 60 kilometers per hour.

15. The electronic device according to claim 10, wherein the driving speed is within a range between about 10 kilometers per hour and 60 kilometers per hour.

* * * * *